US006726062B2

(12) United States Patent
Segiet

(10) Patent No.: US 6,726,062 B2
(45) Date of Patent: Apr. 27, 2004

(54) SYSTEM FOR PRODUCING BEVERAGES

(75) Inventor: William Segiet, Chatham, IL (US)

(73) Assignee: Bunn-O-Matic Corporation, Springfield, IL (US)

( * ) Notice: Subject to any disclaimer, the term of this patent is extended or adjusted under 35 U.S.C. 154(b) by 162 days.

(21) Appl. No.: 10/095,221

(22) Filed: Mar. 11, 2002

(65) Prior Publication Data

US 2003/0168472 A1 Sep. 11, 2003

(51) Int. Cl.[7] ..... B67D 5/66
(52) U.S. Cl. ..... 222/129.1; 222/136; 222/144.5
(58) Field of Search ..... 222/129.1, 136, 222/144.5, 145.1, 372; 137/565.01

(56) References Cited

U.S. PATENT DOCUMENTS

| | | | | | |
|---|---|---|---|---|---|
| 4,753,370 | A | * | 6/1988 | Rudick | 222/105 |
| 5,601,210 | A | | 2/1997 | Kelly et al. | 222/129.1 |
| 5,797,519 | A | * | 8/1998 | Schroeder et al. | 222/129.1 |
| 5,890,626 | A | | 4/1999 | Wolski et al. | 222/129.1 |
| 6,170,707 | B1 | | 1/2001 | Wolski et al. | 222/129.1 |
| 6,196,422 | B1 | * | 3/2001 | Tuyls et al. | 222/129.1 |
| 6,273,295 | B1 | * | 8/2001 | Quartarone et al. | 222/67 |
| 6,394,312 | B1 | * | 5/2002 | Endou | 222/129.1 |
| 6,609,431 | B1 | * | 8/2003 | Tietsworth et al. | 73/861.52 |

* cited by examiner

*Primary Examiner*—Gene Mancene
*Assistant Examiner*—Patrick Buechner
(74) *Attorney, Agent, or Firm*—Barnes & Thornburg

(57) ABSTRACT

A system is provided for producing at least two beverages having different percentages of water. The system comprises: (a) a first container containing a first water-soluble compound and a second container containing a second water-soluble compound; (b) a valve assembly associated with the first and second containers for selectively receiving the first and second water-soluble compounds, the valve assembly including a valve having a first position for receiving the first water-soluble compound and a second position for receiving the second water-soluble compound; (c) a pump associated with the valve assembly adapted to be associated with a water source, the pump adapted to pump the first water-soluble compound from the valve assembly for mixing with water when the valve is in the first position and to pump the second water-soluble compound from the valve assembly for mixing with water when the valve is in the second position; and (d) a processor for signaling the pump to operate at a first speed when the valve is in the first position and a second speed when the valve is in the second position to selectively product the first beverage and the second beverage. The first pump speed desirably is different from the second pump speed. The system may comprise a housing containing the valve assembly, the pump and the processor, and the first and second containers desirably are spaced from the housing. The system may be able to produce additional beverages having different percentages of water, and thus may further include additional containers, valve assemblies, pumps and dispense valves.

23 Claims, 3 Drawing Sheets

SYSTEM FOR PRODUCING BEVERAGES

The present invention relates to a system for producing a plurality of different beverages from beverage concentrates.

BACKGROUND

Beverage dispensing systems that dispense a variety of different juices or other beverages made from beverage concentrates are known. The systems typically include a housing that enables an operator to select from a variety of different choices a specific beverage for consumption by pressing a solenoid button or the like associated with the desired beverage. The housing may contain a plurality of different containers containing the various beverage concentrates corresponding to the various beverage choices. Alternatively, some or all of the beverage concentrates may be contained in containers remote from the housing. Such remote containers, often referred to as "bag in the box", provide several benefits, such as ease of changeability of the containers and lower cost beverages.

Typically, the beverage system includes pumps contained within the housing for pumping respective beverage concentrates from the respective containers. The pump speed affects the "brix" of the beverage produced from the beverage concentrate, meaning that it affects the percentage of water contained in the produced beverage and thus the quality of the taste of the produced beverage. The pump speed necessary to achieve the desired taste differs depending on the particular beverage concentrate. As a result, when an operator changes the beverage concentrate to a new flavor, the pump speed also needs to be adjusted so that the beverage produced has the desired brix associated with the beverage concentrate and thus the desired taste.

SUMMARY

A system is provided for producing at least two beverages having different percentages of water. The system comprises: (a) a first container containing a first water-soluble compound and a second container containing a second water-soluble compound; (b) a valve assembly associated with the first and second containers for selectively receiving the first and second water-soluble compounds, the valve assembly including a valve having a first position for receiving the first water-soluble compound and a second position for receiving the second water-soluble compound; (c) a pump associated with the valve assembly adapted to be associated with a water source, the pump adapted to pump the first water-soluble compound from the valve assembly for mixing with water when the valve is in the first position and to pump the second water-soluble compound from the valve assembly for mixing with water when the valve is in the second position; and (d) a processor for signaling the pump to operate at a first speed when the valve is in the first position and a second speed when the valve is in the second position to selectively produce the first beverage and the second beverage. The first pump speed desirably is different from the second pump speed. The system desirably also includes a dispense valve for dispensing the first and second beverages. The dispense valve desirably is controlled by the processor. Each of the water-soluble liquid compounds desirably is in the form of a liquid concentrate comprising sugar or artificial sweetener or the like or, in accordance with alternative embodiments, may be in the form of a powder concentrate.

In a preferred embodiment, the system further comprises a housing containing the valve assembly, the pump and the processor, and the first and second containers are spaced from the housing. The system may be able to produce additional beverages having different percentages of water, and thus may further include additional containers, valve assemblies and pumps that may be associated with the housing. For example, the system may further include: (a) a third container containing a third water-soluble compound and a fourth container containing a fourth water-soluble compound; (b) a second valve assembly associated with the third and fourth containers for selectively receiving the third and fourth water-soluble compounds, the second valve assembly including a second valve having a first position for receiving the third water-soluble compound from the third container and a second position for receiving the fourth water-soluble compound from the fourth container; and (c) a second pump associated with the second valve assembly adapted to be associated with the water source, the pump adapted to pump the third water-soluble compound from the second valve assembly for mixing with water when the second valve is in the first position and to pump the fourth water-soluble compound from the second valve assembly for mixing with water when the second valve is in the second position. The processor desirably also signals the second pump to operate at a third speed when the second valve is in the first position and a fourth speed when the second valve is in the second position to selectively produce the third beverage and the fourth beverage. Desirably, such system also includes another dispense valve corresponding to the produced beverages.

Each valve assembly may have any suitable construction and desirably includes a knob for selecting the desired position of the valve and thus for selecting the desired container. The valve assembly may include a first inlet for receiving the first water-soluble compound and a second inlet for receiving the second water-soluble compound.

DETAILED DESCRIPTION OF PREFERRED EMBODIMENTS

Figure 1:
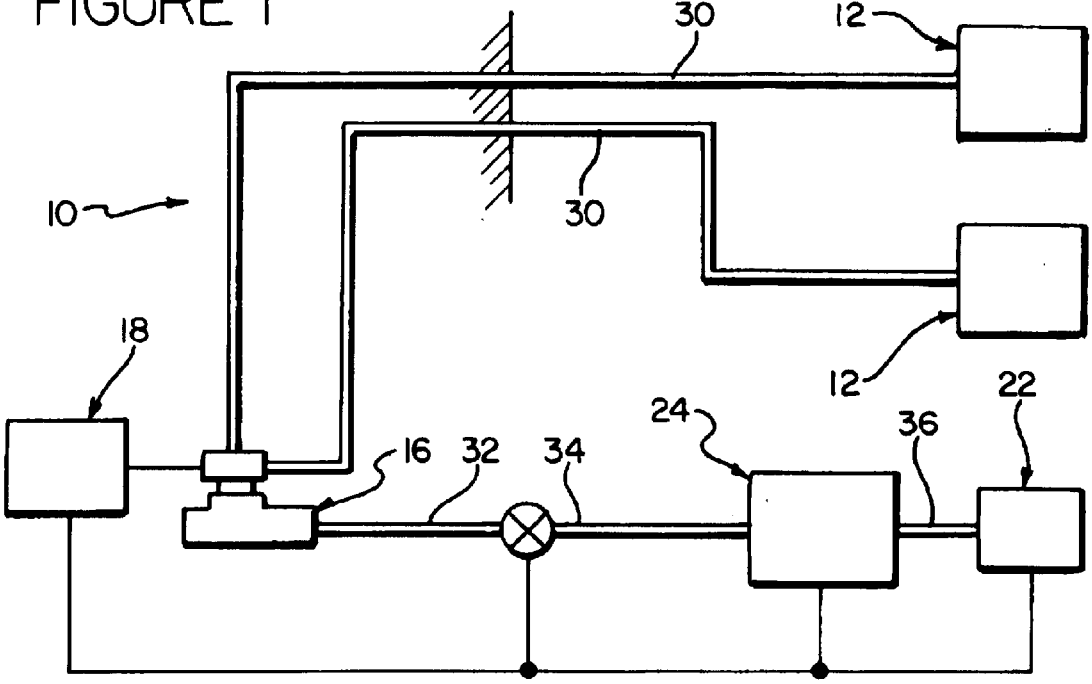
FIG. 1 is a schematic illustration of a system for producing beverages in accordance with an embodiment of the invention.

FIG. 1 illustrates a system 10 for controlling the production of at least two beverages of different brix in accordance with an embodiment of the invention. The beverages may be in the form of any cold or hot drink, including, for example, juices, soft drinks, coffee or tea drinks, alcoholic drinks, soups, etc.

The illustrated system 10 comprises a pair of containers 12, a valve assembly 16, a processor 18, a pump 20, a water source 22 and a dispense valve 24. The system 10 also includes a pair of conduits 30 connecting the containers 12 to the valve assembly 16, a conduit 32 connecting the valve assembly to the pump 20, a conduit 34 connecting the pump to the dispense valve 24 and a conduit 36 connecting the water source 22 to the dispense valve 24. Each of the containers 12 desirably contains a water-soluble liquid compound desirably in the form of a liquid concentrate comprising sugar or artificial sweetener or the like. In accordance with alternative embodiments, the containers instead may comprise a powder concentrate. Desirably, the valve assembly 16 has two alternate positions and thus is adapted to receive and dispense therethrough beverage concentrate selectively from one of the two containers 12.

The processor 18 desirably is electrically connected to the valve assembly 16, the pump 20, the water source 22 and the dispense valve 24. In a preferred embodiment, prior to actuation of the dispense valve 24, the valve assembly 16 is switched to the position that corresponds to one of the containers 12 containing the desired beverage concentrate, i.e., the selected container. Upon actuation of the dispense valve 24, the processor 18 activates the pump 20 to pump beverage concentrate from the selected container 12 through the corresponding conduit 30, the valve assembly 16 and the conduit 32. The speed of the pump 20 is pre-set by the processor 18 and corresponds to a desired pump speed for the beverage concentrate contained within the selected container 12, and, in particular, to the desired brix associated with the beverage concentrate contained within the selected container. The beverage concentrate then passes through conduit 34 where it is mixed with water from the water source 22 to produce the desired beverage. The beverage concentrate is mixed with the water as, or before, it is dispensed from the dispense valve 24.

If desired, the valve assembly 16 can at any time be switched to the alternate position to select the other container 12 and thus to select the other available beverage concentrate. Upon subsequent actuation of the dispense valve 24, the system 10 operates in a similar manner except that beverage concentrate instead is pumped from the other container 12 and the processor 18 signals the pump 20 to operate at a desirably different pre-set speed which corresponds to the beverage concentrate contained within the other container 12, and, in particular, to the desired brix associated with the beverage concentrate contained within the other container. Accordingly, the illustrated beverage system 10 can provide two different beverages having two different brix.

Figure 2:
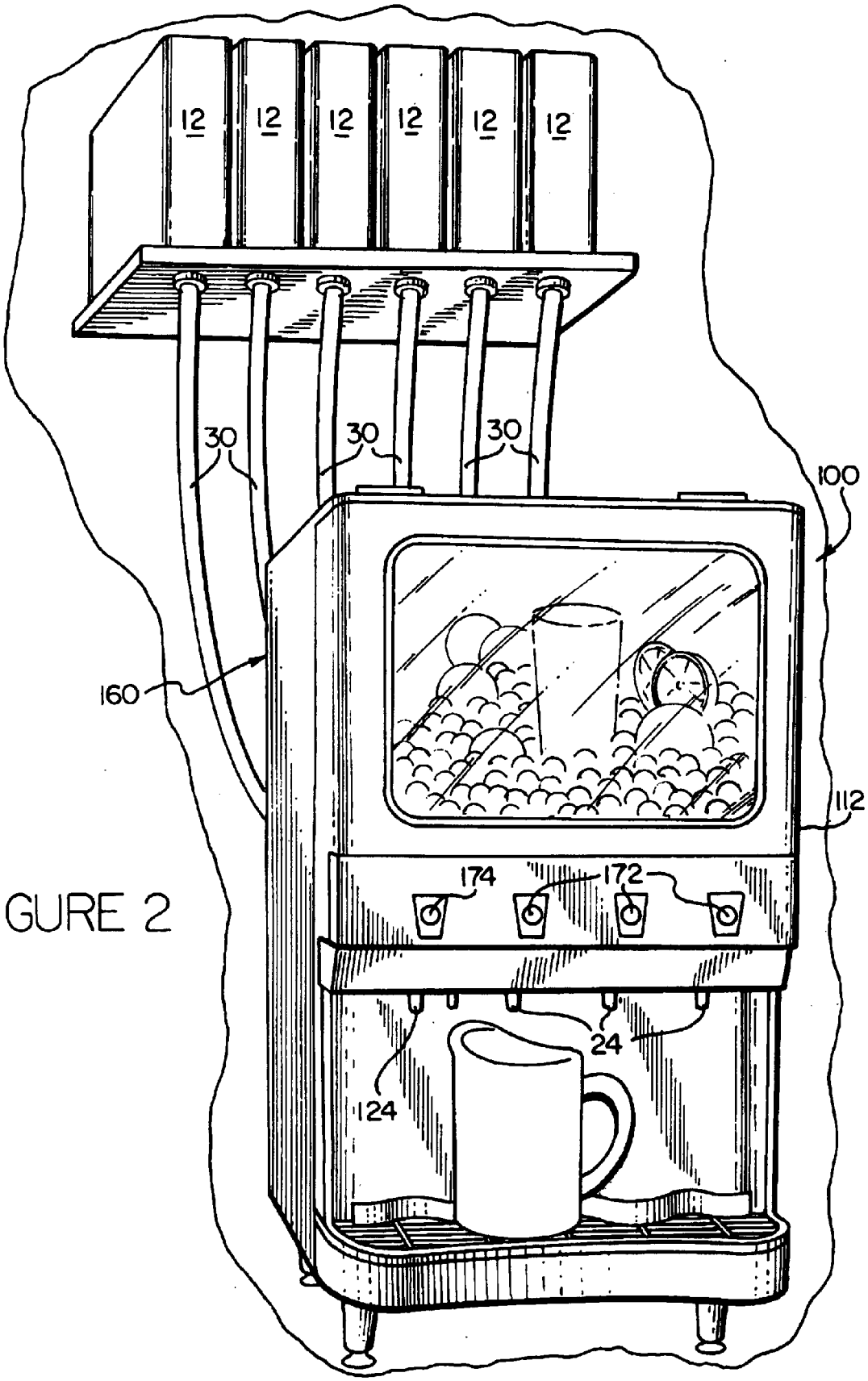
FIG. 2 is a perspective view of an exemplary beverage dispensing device incorporating several systems for producing beverages of FIG. 1.
Figure 3:
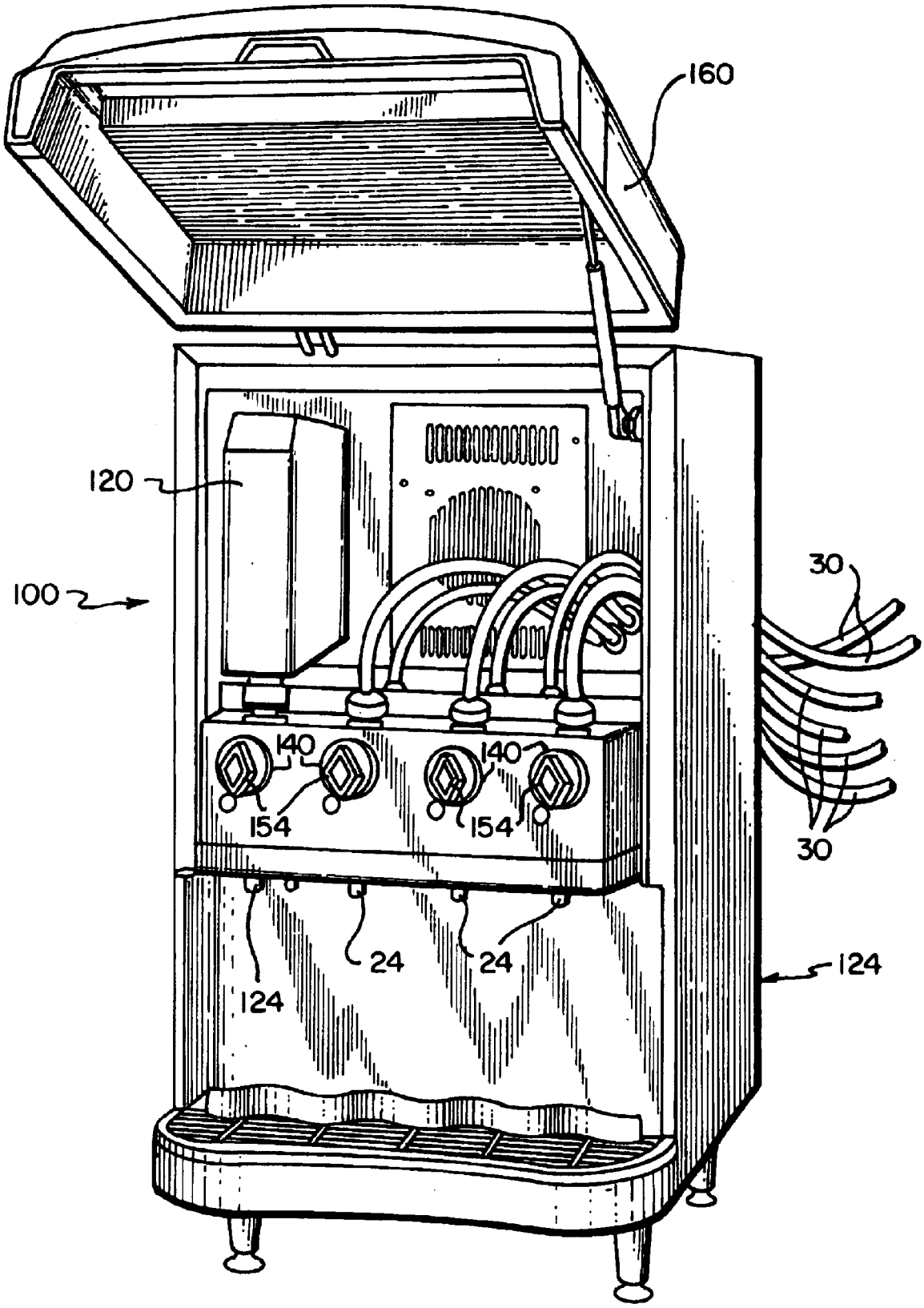
FIG. 3 is a perspective broken view of the beverage dispensing device of FIG. 2, illustrating the housing in an open position to illustrate access to the knobs of the valve assemblies of the beverage dispensing systems of FIG. 2 also illustrating the container within the housing for producing an additional beverage.

The beverage system 10 may be associated with any suitable beverage dispensing system or device. The present invention may, for example, also include a beverage system that includes several of the beverage systems 10 incorporated in any suitable beverage dispensing device. FIGS. 2 and 3, for example, illustrate a beverage dispensing system 100 including three beverage systems of the type illustrated in FIG. 1, each adapted to product two beverages of different brix. The illustrated beverage system 100 is also able to produce an additional beverage produced from a refrigerated beverage concentrate as described below.

The illustrated beverage dispensing system 100 comprises generally a housing 112, a plurality of the containers 12, a plurality of the valve assemblies 16, a plurality of the conduits 30 extending into the housing and connecting the containers to the valve assembly, and a container 120 within the housing. Each respective pair of the conduits 30 connects one of the valve assemblies 16 to one of the pairs of the containers 12. As with the containers 12, the container 120 desirably contains a water-soluble liquid compound desirably in the form of a liquid concentrate comprising sugar or artificial sweetener or the like.

In a preferred embodiment, the containers 12 are spaced, in whole or in part, from the housing 112. The containers 12 may, for example, be in the form of "bag in the box" containers used in connection with beverage dispensing systems currently used in the industry. The containers 12 may instead be positioned within the housing 112 and may communicate with the valve assembly 16 in any other suitable manner in accordance with alternative embodiments. For example, if the containers 12 contain powder concentrate, the containers may be positioned immediately above the valve assembly 16.

The container 120 is illustrated as being located within the housing 112 so that it can be refrigerated. For example, orange juice dispensed from beverage dispensing systems typically tastes better when the concentrate is maintained in a refrigerated state. Accordingly, in the illustrated embodiment, the container 120 may contain orange juice concentrate, whereas the containers 12 may contain juice or other beverage concentrates that might not be maintained in a refrigerated state.

Each of the beverage dispensing systems of the illustrated beverage dispensing system 100 desirably includes all of the other components of the beverage system 10 of FIG. 1, including the pump 20 (not shown in FIGS. 2 and 3), the water source 22 (not shown in FIGS. 2 and 3), the dispense valve 24 and the various conduits. Desirably, the illustrated beverage dispensing system 100 includes a single processor 18 (not shown in FIGS. 2 and 3) that is electrically connected to all of the beverage dispensing systems associated with the beverage dispensing device, and a single water source. As to the beverage produced from the beverage concentrate of container 120, the illustrated beverage dispensing system 100 also may include a pump (not shown), conduits (not shown) and a dispensing valve 124, which may also be electrically connected to the processor 18.

Figure 4:
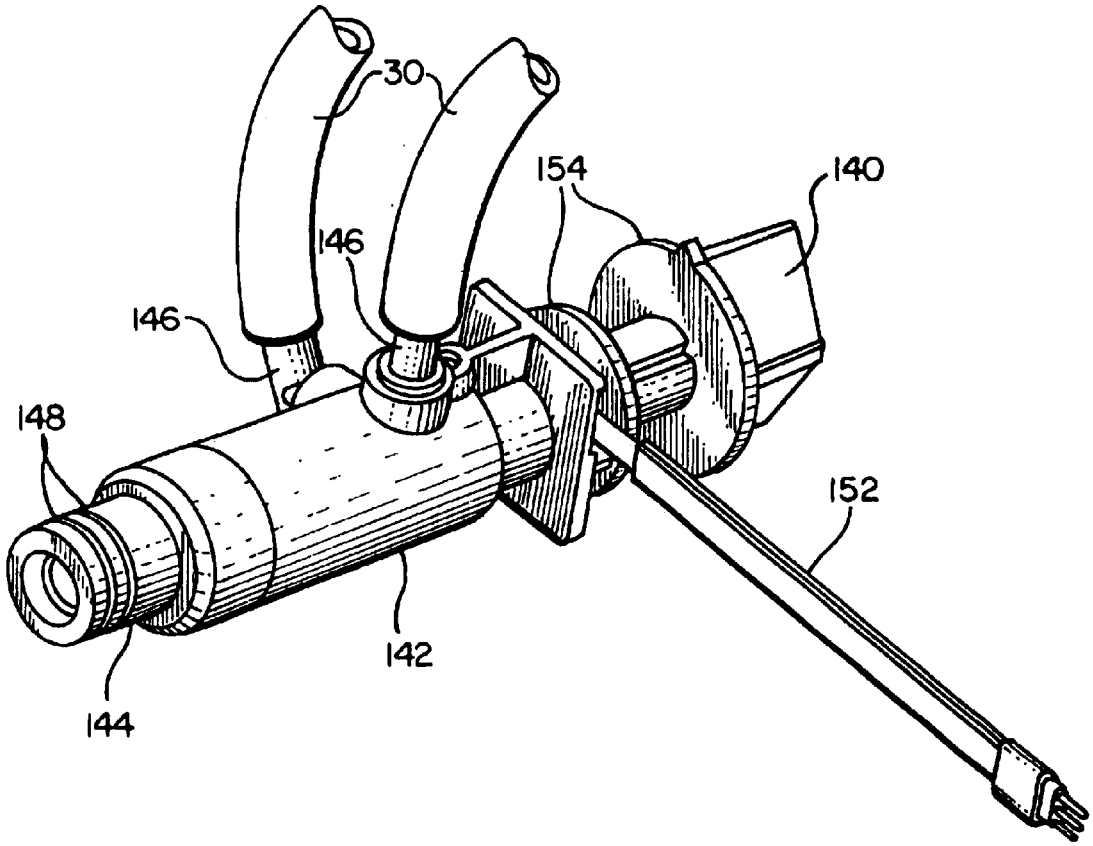
FIG. 4 is a perspective view of the valve assembly included in each of the beverage dispensing systems of FIGS. 3 and 4, including a broken view of the conduits secured to the valve assembly.

The valve assemblies 16 may have any suitable configuration and be constructed of any suitable materials. In the illustrated embodiment of FIG. 4, for example, each valve assembly 16 includes a knob 140, a valve housing 142, an adapter 144 to facilitate securement of the valve assembly to the conduit 32 to transport concentrate for mixing, and a pair of inlet tubes 146 to receive concentrates from the pair of containers 12. The valve assembly 16 also includes a pair of O-rings 148 to facilitate securement of the conduit 32. The knob 140 is for manually selecting the desired container 12 and thus the desired beverage concentrate.

The valve assembly 16 may be electrically connected to the processor 18 in any suitable manner. The illustrated valve assembly 16, for example, includes a membrane switch assembly 152 electrically connected to the processor 18. The switch assembly 152 is adapted to send a container selection signal to the processor 18 so that the processor can set the speed of the respective pump 20 associated with the appropriate brix of the beverage concentrate corresponding to the selected container 12.

Each of the illustrated valve assemblies 16 may be secured to the housing 112 in any suitable manner desirably such that the knob 140 can be rotated to effect the selection of the desired container 12. In the illustrated embodiment, for example, the valve assembly 16 includes a pair of mounting members 154 for securing on opposed sides of the mounting panel 156 of the housing 112. Any suitable mounting hardware (not shown) may also be used to mount the mounting members 154 to the mounting panel 156.

In the illustrated embodiment, the front face 160 of the housing 112 pivots between open and closed positions to selectively provide access to the knobs 140. The illustrated front face 160 includes three solenoid buttons 172 to correspond to each of the selected containers 12 and a solenoid 174 to correspond to the container 120. Thus, in the illustrated embodiment, after each of the knobs 140 is set to select a single respective beverage and the front face 160 is pivoted to a closed position, the solenoid buttons 172 and 174 provide for the selection of four available beverages. In order to make a substitute beverage selection available, the front face 160 is opened and some or all of the three knobs 140 are switched to select beverage concentrate from the other respective container 12 and thus to also switch the pump speed associated with the other respective container 12. Accordingly, in the illustrated embodiment, for example, the knobs 140 can be positioned in the morning to provide three morning drinks and can be re-positioned in the afternoon to provide three different drinks and, in particular, three drinks having brix different from the morning drinks.

In the illustrated embodiment, activation of any of the selected solenoid buttons 172 causes the processor 18 to activate the pump 20 associated with the selection to cause the respective beverage concentrate to be pumped from the respective selected container 12 through the respective valve assembly 16 and through conduit 32. The concentrate is mixed with water and then dispensed from the beverage dispensing system 100 through the respective dispensing valve 24. If instead the solenoid button 174 is activated, the processor activates the pump associated with the container 120 causing beverage concentrate to be pumped from the container, mixed with water and dispensed from the dispensing valve 124 in any suitable manner.

The pumps 20 may have any suitable configuration that desirably effects mixing and delivery of the selected beverage. The pump desirably operates at a speed corresponding to the signal received from the processor 18. The pumps 18 may, for example, be any commercially available pumps used in beverage dispensing systems. The pumps may, for example, be pumps of the types described in U.S. patent application Ser. Nos. 09/602,908 and 09/603,484, both filed on Jun. 23, 2000, which are incorporated herein by reference.

The processor 18 may have any suitable configuration and may be programmed in any suitable manner desirably such that it is able to store at least two different pump speeds for each pump 20 so that each pump is able to facilitate achieving at least two different brix, depending on the position of the knob 140 of the respective valve assembly 16. The processor 18 desirably also is programmed to activate the water source 22 and the appropriate dispense valve 24 to complete the beverage production. The processor 18 desirably also is able to activate the pump and dispensing valve 124 associated with the container 120. Accordingly, in the illustrated embodiment, the beverage dispensing device 100 is able to produce seven different beverages that may have seven different brix. In particular, it is able to produce two different beverages of different brix from each valve assembly 16 and one beverage from the container 120.

While the invention has been illustrated and described in detail in the drawings and foregoing description, such an illustration and description is to be considered as exemplary and not restrictive in character, it being understood that only illustrative embodiments have been shown and described and that all changes and modifications that come within the spirit of the invention are desired to be protected.

What is claimed:

1. A device for producing at least two beverages having different percentages of water, the device comprising:

(a) a first container containing a first water-soluble compound and a second container containing a second water-soluble compound;

(b) a valve assembly associated with the first and second containers for selectively receiving the first and second water-soluble compounds, the valve assembly including a valve having a first position for receiving the first water-soluble compound and a second position for receiving the second water-soluble compound;

(c) a pump associated with the valve assembly adapted to be associated with a water source, the pump adapted to pump the first water-soluble compound from the valve assembly for mixing with water when the valve is in the first position and to pump the second water-soluble compound from the valve assembly for mixing with water when the valve is in the second position; and (d) a processor for signaling the pump to operate at a first speed when the valve is in the first position and a second speed when the valve is in the second position to selectively produce the first beverage and the second beverage.

2. The device of claim 1 further comprising a housing containing the valve assembly, the pump and the processor.

3. The device of claim 2 wherein the first and second containers are spaced from the housing.

4. The device of claim 1 wherein the first pump speed is different from the second pump speed.

5. The device of claim 1 wherein at least one of the first and second water-soluble compounds comprises sugar.

6. The device of claim 1 wherein at least one of the first and second water soluble-compounds comprise liquid concentrate.

7. The device of claim 1 wherein at least one of the first and second water-soluble compounds comprise powder concentrate.

8. The device of claim 1 for further producing at least two additional beverages having different percentages of water, the device further including:

(a) a third container containing a third water-soluble compound and a fourth container containing a fourth water-soluble compound;

(b) a second valve assembly associated with the third and fourth containers for selectively receiving the third and fourth water soluble compounds, the second valve assembly including a second valve having a first position for receiving the third water-soluble compound from the third container and a second position for receiving the fourth water-soluble compound from the fourth container; and (c) a second pump associated with the second valve assembly adapted to be associated with the water source, the pump adapted to pump the third water-soluble compound from the second valve assembly for mixing with water when the second valve is in the first position and to pump the fourth water-soluble compound from the second valve assembly for mixing with water when the second valve is in the second position;

the processor also for signaling the second pump to operate at a third speed when the second valve is in the first position and a fourth speed when the second valve is in the second position to selectively produce the third beverage and the fourth beverage.

9. The device of claim 8 wherein at least one of the third and fourth water-soluble compounds comprises sugar.

10. The device of claim 8 wherein the third and fourth water soluble-compounds comprise liquid concentrate.

11. The device of claim 1 further including a dispense valve for dispensing the first and second beverages, the dispense valve being controlled by the processor.

12. The device of claim 1 wherein the pump is adapted to be upstream of the water source.

13. The device of claim 1 wherein the valve assembly includes a first inlet for receiving the first water-soluble compound and a second inlet for receiving the second water-soluble compound.

14. A device for producing at least two beverages having different percentages of water, the device comprising:

(a) a housing;

(a) a first container containing a first water-soluble compound and a second container containing a second water-soluble compound;

(b) a valve assembly contained within the housing and associated with the first and second containers for selectively receiving the first and second water-soluble compounds, the valve assembly including a valve having a first position for receiving the first water-soluble compound and a second position for receiving the second water-soluble compound;

(c) a pump contained within the housing and associated with the valve assembly, the pump adapted to be associated with a water source and adapted to pump the first water-soluble compound from the valve assembly for mixing with water when the valve is in the first position and to pump the second water-soluble compound from the valve assembly for mixing with water when the valve is in the second position;

(d) a dispense valve associated with the housing for selectively dispensing the first and second beverages; and (e) a processor contained within the housing for signaling the pump to operate at a first speed when the valve is in the first position and a second speed when the valve is in the second position and to selectively produce for dispensing from the dispense valve the first beverage and the second beverage.

15. The device of claim 14 wherein the first and second containers are spaced from the housing.

16. The device of claim 14 wherein the first pump speed is different from the second pump speed.

17. The device of claim 14 wherein at least one of the water-soluble compounds comprises sugar.

18. The device of claim 14 wherein at least one of the water soluble-compounds comprise liquid concentrate.

19. The device of claim 14 wherein at least one of the water-soluble compounds comprise powder concentrate.

20. A device for producing a plurality of beverages having different percentages of water, the device comprising;

(a) a plurality of containers containing water soluble compounds;

(b) a plurality of valve assemblies, each valve assembly associated with a respective pair of containers for selectively receiving the water-soluble compounds from the containers of the respective pair and including a valve having a first position for receiving the water-soluble compound from one container of the respective pair and a second position for receiving the water-soluble compound from the other container of the respective pair;

(c) a plurality of pumps, each pump associated with a respective valve assembly and adapted to be associated with a water source, each pump adapted to pump the water soluble compound from the one container associated with the respective valve assembly for mixing with water when the valve of the respective valve assembly is in the first position and to pump water-soluble compound from the other container associated with the respective valve assembly for mixing with water when the valve of the respective valve assembly is in the second position; and (d) a processor for signaling a respective pump to operate at a first respective speed when the valve of the respective valve assembly is in the first position and a second respective speed when the valve of the respective valve assembly is in the second position to selectively produce two of the beverages.

21. The device of claim 20 further comprising a housing containing the valve assemblies, the pumps and the processor.

22. The device of claim 21 wherein the plurality of containers are spaced from the housing.

23. The device of claim 22 further including a plurality of dispense valves for dispensing the respective beverages from the housing, the dispense valves being controlled by the processor.

* * * * *